United States Patent [19]

Steinmetz, Jr.

[11] Patent Number: 4,696,398

[45] Date of Patent: Sep. 29, 1987

[54] FREE DROP LIQUID CONTAINER WITH EXTENDABLE SPOUT

[76] Inventor: Floyd Steinmetz, Jr., c/o Steinmetz & Sons Machinery Co., P.O. Box 393, Moscow, Pa. 18444

[21] Appl. No.: 661,959

[22] Filed: Oct. 17, 1984

[51] Int. Cl.[4] ..... B65D 85/72

[52] U.S. Cl. ..... 206/521; 16/125; 150/55; 220/85 SP; 220/94 A; 220/361; 222/538; 244/135 B; 294/158; 383/119

[58] Field of Search ..... 206/521; 220/453, 462, 220/900, 1 B, 253, 254, 3, 94 R, 361, 365, 94 A, 85 SP, 85 D, DIG. 12; 383/119, 96, 901, 904, 24–26; 244/137 R, 135 B, 138 R; 222/537–539; 229/52 AC, 52 B; 294/148, 158; 16/110 R, 111 R, 122, 125; 150/55 R

[56] References Cited

U.S. PATENT DOCUMENTS

| | | | |
|---|---|---|---|
| 868,598 | 10/1907 | Coleman | 220/85 SP |
| 1,239,184 | 9/1917 | Hopkins | 16/111 R |
| 1,600,350 | 9/1926 | Mensik | 222/539 |
| 1,970,011 | 8/1934 | Ludlow, Jr. | 383/96 X |
| 2,072,802 | 3/1937 | Kraft . | |
| 2,444,996 | 7/1948 | Lebenhart | 383/26 |
| 2,566,838 | 9/1951 | Hurt . | |
| 2,784,755 | 3/1957 | Bender | 206/521 |
| 2,788,821 | 4/1957 | Marelle | 206/521 |
| 2,991,815 | 7/1961 | Pfeiffer | 206/521 |
| 3,057,509 | 10/1962 | Bernd | 220/465 X |
| 3,072,285 | 1/1963 | Aileo . | |
| 3,117,606 | 1/1964 | Hastings | 206/521 X |
| 3,190,332 | 6/1965 | Bernard | 383/96 |
| 3,214,166 | 10/1965 | Gaudet | 16/125 |
| 3,301,451 | 1/1967 | Halverson | 294/158 |
| 3,377,766 | 4/1968 | Nelson . | |
| 3,383,017 | 5/1968 | Krings | 206/521 X |
| 3,432,070 | 3/1969 | Carpenter, Jr. et al. | 220/465 X |
| 3,581,792 | 6/1971 | Weiss et al. | 206/521 |
| 3,690,500 | 9/1972 | Remane . | |
| 3,825,145 | 7/1974 | Reynolds . | |
| 3,848,766 | 11/1974 | Ganti et al. | 229/52 AC |
| 3,865,270 | 2/1975 | Petersson | 220/85 SP X |
| 3,938,687 | 2/1976 | Maier et al. | 220/5 R |
| 3,940,001 | 2/1976 | Haefner et al. | 215/12 R X |
| 3,985,257 | 10/1976 | Shaffer et al. . | |
| 4,036,390 | 7/1977 | Morse . | |
| 4,567,918 | 2/1986 | Curiel | 150/55 |

*Primary Examiner*—Stephen Marcus
*Assistant Examiner*—Bryon Gehman
*Attorney, Agent, or Firm*—John F. A. Earley; John F. A. Earley, III

[57] ABSTRACT

A free drop container for liquids and especially potable liquids such as water. The container includes a molded impact resistant shell having a generally spherical shape. A port in the shell defines a hole through the shell wall, with the hole having a first diameter extending from the exterior partially through the shell wall and a second smaller diameter extending through the rest of the shell wall to the interior thereof such that the two diameters define a seat in the shell wall. A screw-in cap is removably fitted to close the first diameter hole preferably by cooperative threading with the circumferential surface of the first diameter hole. A pour spout is sized to slidably fit the second diameter hole, and can extend out from the shell for pouring when the cap is removed. A plug is removably fitted in the pour spout, and a resilient impact-resistant lining is provided that does not crack or break on impact and covers the interior of the shell for contact with potable liquids inside the shell.

The potable liquid in the container is delivered to a predetermined ground location by dropping the filled container from an aircraft traveling at a speed up to 100 knots at an altitude of up to 1,000 feet or more.

29 Claims, 6 Drawing Figures

FREE DROP LIQUID CONTAINER WITH EXTENDABLE SPOUT

BACKGROUND OF THE INVENTION

1. Field of the Invention

This invention relates to a free drop liquid container which is capable of supplying potable liquids such as drinking water to specific predetermined locations on the ground using aircraft to drop the containers.

2. Description of the Prior Art

Traditionally, personnel, such as military troops, who are situated in remote locations have had to bring with them all of their supplies or depend upon being able to obtain those supplies at or near their remote location. When this has not been possible or practical, supplies have been brought to these remote locations via aircraft, such as airplanes, helicopters and the like. However, as everyone who has dropped a container of liquid is aware, impact on a rigid container imparts significant stress to the container which may cause it to break open.

Parachutes and similar air resistant devices have been used to substantially reduce the impact of the container on the ground. While this approach can be used to supply remote locations with water and the like, the solution is not without its own drawbacks and is not considered to be a satisfactory answer to the needs of remote ground personnel. Parachutes and other similar devices are much more difficult to accurately aim toward a ground location than are free fall objects. Winds, cross currents, elevation variations and the like all contribute to the lack of control. Also, the time of fall is substantially extended, thereby significantly increasing the length of time which the ground personnel are exposed awaiting the container. In arctic or severe weather conditions, additional exposure can subject the ground personnel to unnecessry and unhealthy exposure. In military operations, the additional time and visibility of such a drop is undesirable because it may expose troops to enemy fire.

In the alternative, if velocity retarding devices such as parachutes are not used, the impact of the container with the ground may be so great that the container is ruptured and the liquid is lost.

As a result, efforts have been made in one instance to provide a container which can be dropped from an aircraft without benefit of air speed retarding devices. The proposed device included seven bags within bags, filled with water and placed in a corrugated box. Unfortunately, the percentage of such containers that survived the drop was far below practical acceptance levels. While some success was minimally achieved at lower air speed, the unit was not found to be useful at air speeds above about 65 knots. It is difficult to operate at low speeds, and it is undesirable because it may expose the aircraft to ground fire.

It would be a great advantage to those who operate in remote locations if they could be supplied water and other potable liquids via a free drop container. Ideally the container would have up to a 5 gallon capacity, and would survive free fall from an aircraft traveling at up to 100 knots or more at an altitude up to 1000 feet. In addition, the device should have tie down capability to withstand up to 3 g acceleration and have grips or handles for easy handling. The container should be suitable for carrying potable liquids such as water in contact with FDA (U.S. Federal Drug Administration) approved materials, should be easily and quickly filled and emptied, and should be resealable. The present invention accomplishes these objects.

SUMMARY OF THE INVENTION

It has now been discovered that a new and useful free drop container for potable liquids can be provided in the following manner. Specifically, the container is made from a molded impact resistant shell having a generally spherical shape.

The shell includes a port means which defines a hole through the wall of the shell, such that the hole has a first diameter extending from the exterior partially through the shell wall; and the hole has a second, smaller diameter extending through the rest of the shell wall to the interior thereof, so that the two diameters define a seat in the shell wall.

A cap is removably fitted, preferably by cooperative threading, so as to close the first diameter portion of the hole. In one embodiment the cap is supported by the seat when threaded into the first diameter hole. Both the shell and the cap are made from polyether based urethane or other high impact resistant material and are contour shaped to each other. The cap may have a slot for aiding in rotating it to remove it.

A pour spout is sized to slidably fit the second diameter hole and is positioned to extend out from the shell when the cap is removed. The spout includes stop means for preventing it from easily being removed from the hole. A plug means is removably fitted in the pour spout to seal the interior of the shell. In a preferred embodiment, seal means prevents flow of liquid between the pour spout and the second diameter hole, as well as between the plug means and the pour spout. For easy removal, the plug may include a pull lip portion extending outwardly beyond the edges of the pour spout.

The shell itself is generally spherical in shape. Preferably it will have slightly thicker walls at diametrically opposed locations. At one location the thicker wall includes a flat exterior portion forming a base. The port means defining the hole is located at the diametrically opposed end from the base. Also, at the port end, a plurality of handle holes are provided in the thick portion of the walls, in what would be considered parallel to the horizon, communicating solely with the exterior of the wall such that a portion of the wall is maintained between the handle holes and the interior of the shell. Handle means are attached through these holes.

Finally, a liner covering the interior of the shell is provided for contact with potable liquids inside the shell. The liner is made of a resilient, impact-resistant material, preferably polyethylene, so that it does not crack or break on impact.

Use of the container is straightforward. The container is filled with a potable liquid and the cap is tightened. Once the container is loaded in a aircraft, the preferred handle means can be used to prevent movement until the drop. Once the filled shell is dropped from the aircraft toward predetermined ground location, at speeds up to 100 knots or more at altitudes of 1000 feet or more, these handles are useful to transport the container once the container is in use at the target location.

BRIEF DESCRIPTION OF THE DRAWINGS

The invention is further described, by way of example, with reference to the accompanying drawings, in which.

DESCRIPTION OF THE PREFERRED EMBODIMENT

Figure 1:
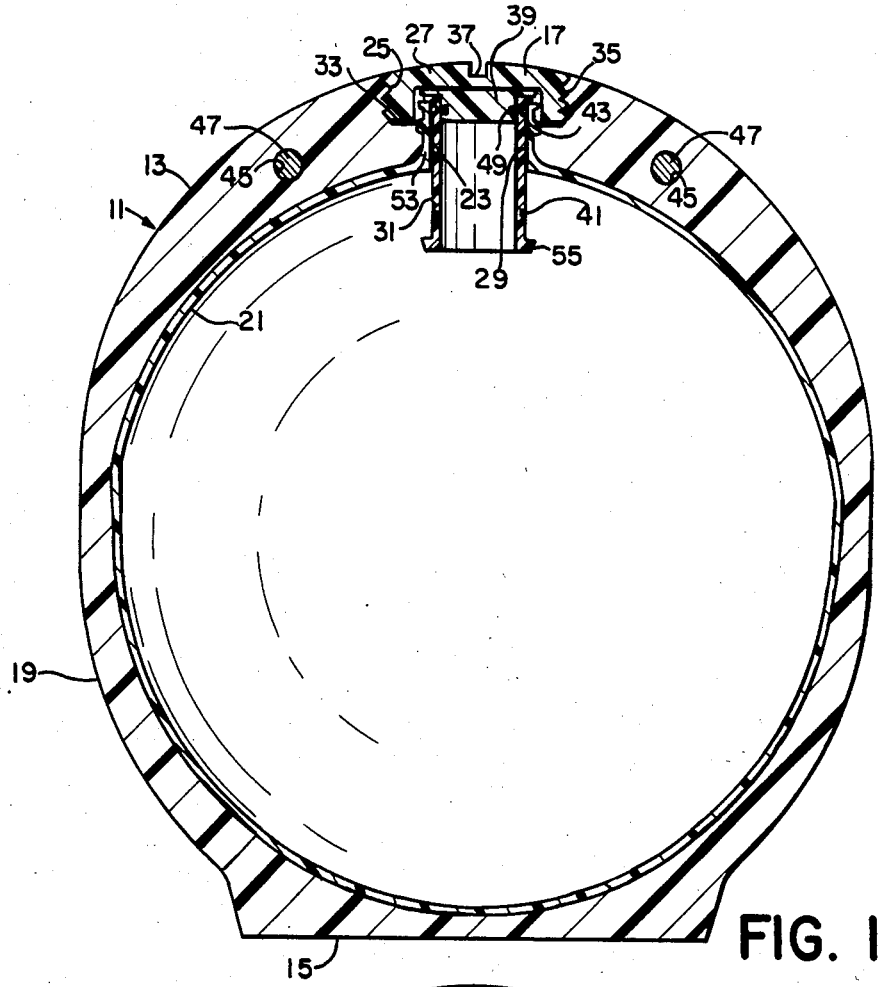
FIG. 1 is a cross-sectional view taken across a container according to the present invention.

Referring to the drawings, a free drop liquid container 11 generally has an outer shell 13 which is generally spherical in shape. The shell is made from a high impact resistant material such as a polyether base urethane. Among the many commercially available polyether base urethanes is DuPont L-213 Adiprene. As seen in FIG. 1, shell 11 has a generally spherical shape, with a flat exterior portion forming a base 15. At a diametrically opposed point from the base 15 of shell 13, is a port means 17. At the port means 17 region, the wall thickness of shell 13 is greater than at the sides 19.

Inside shell 13 is an inner shell or liner 21 covering the interior of the outer shell 13 for contact with potable liquids. Any suitable material which is safe for contact with liquids intended for human consumption, and which does not shatter or crack when the container is dropped from 1000 feet or more, may be used, such as commerically available FDA approved high density linear polyethylene. A preferrable polyethylene is a cross-linkable high density polyethylene such as Marlex CL100 by Phillips Chemical Co., Bartlesville, Okla.

At the opposite end of the shell 13 from the base 15, port means 17 includes a hole 23 which extends from the outside into the interior of the container 11. The port means 17 has a first diameter hole 25 extending part way through the shell 13, into which is threaded a cap 27. The port means 17 has a second smaller diameter hole 29 extending through the rest of the shell 13, into which is fitted a pour spout 31. The port means 17 thus defines a shoulder seat 33 in the shell 13 wherein the larger diameter hole 25 engages the cap 27 and the smaller diameter hole 29 receives the pour spout 31.

The cap 27 is threaded into shell 13 with threads 35, and has a slot 37 to facilitate rotating cap 27 in opening and closing the hole 25. In order to insure that the container 11 is totally closed during use, a plug 39 is inserted into pour spout 31, thereby closing the hole. In order to prevent liquid from leaking between the liner 21 and the pour spout 31, O-ring seals 41 and 43 are provided.

Figure 2:
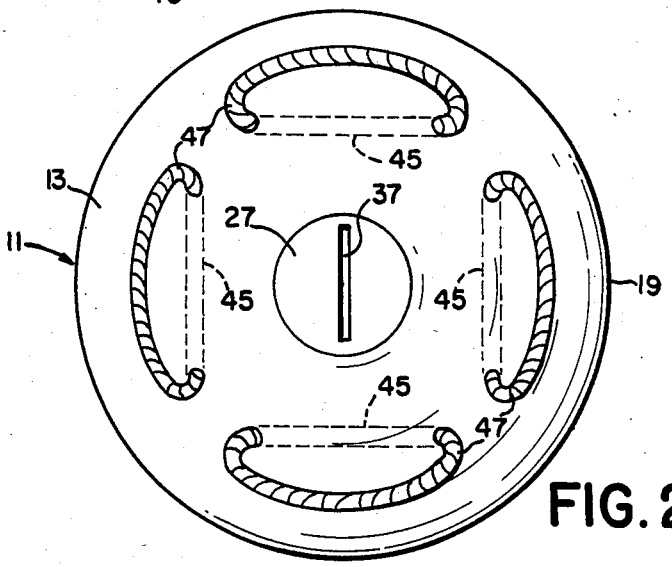
FIG. 2 is a top plan view, not in section, of a complete container.

As shown in FIG. 1 and FIG. 2, a plurality of handle holes 45 are formed in the thick portion of shell 13. These holes 45 are essentially parallel to the ground or horizon, and do not materially weaken the strength of the container. They are positioned to maintain a suitable portion of the shell 13 between the holes 45 and the interior of the shell 13 where the liner 21 is. Fitted into holes 45 are handles 47, which may be made from nylon or other suitable materials, so that the container may be carried easily, loaded onto aircraft, and securely held in place in the aircraft. Once dropped toward the target, the handles 47 add a bit of stabilizing during the free drop to the target.

As has been mentioned, the container is sized to contain a supply of potable liquid such as water so that an adequate quantity is delivered to the ground point. Quantities up to 5 gallons are needed to supply the needs of those in remote locations via an air free fall drop. With these large quantities, however, the containers are subjected to substantial and severe stress.

Figure 3:
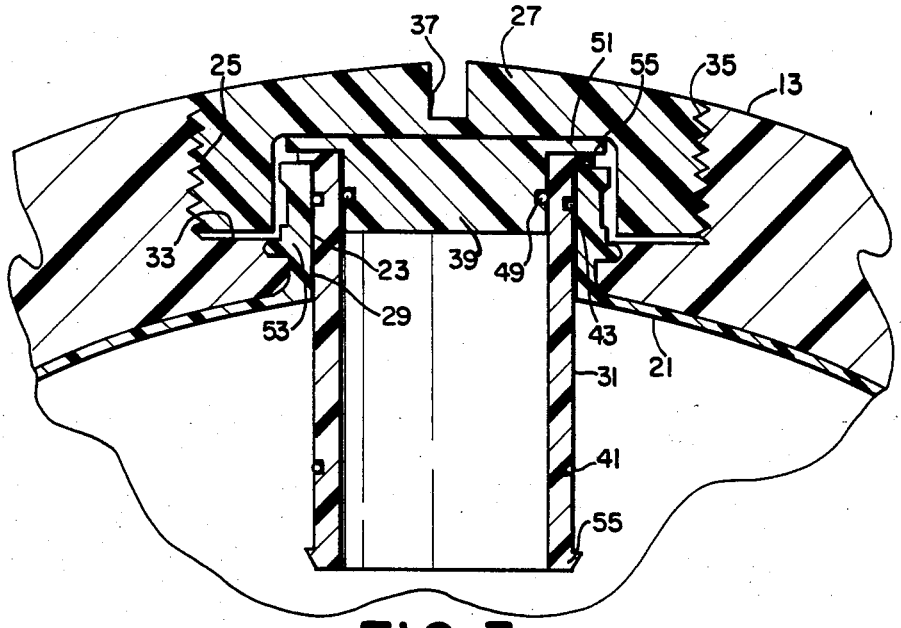
FIG. 3 is an enlarged cut away view, showing an embodiment of the invention in the closed position.
Figure 4:
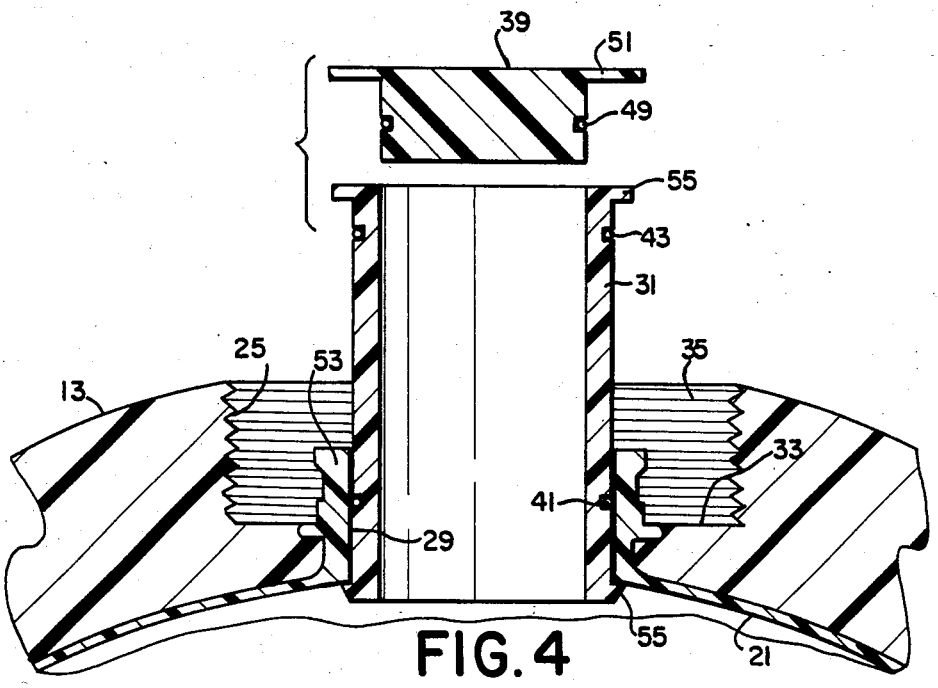
FIG. 4 is an enlarged cut away view, showing the embodiment of FIG. 3 in the open or pouring position.

One embodiment of the cap and pour spout closure of the port means is shown in FIG. 3 in the closed position and in FIG. 4 in the open position. The shell wall 13 has first large diameter hole 25 with a cap 27 threaded into it via threads 35. Slot 37 assists in the removing of the cap 27, and cap 27 has a contoured exterior shaped to conform to the surface of outer shell 13.

Pour spout 31 is recessed into the interior of shell 13 in the second diameter hole 29, so that the spout diameter and cap diameter form a shoulder seat 33 therebetween. O-ring seal 43 prevents fluid flow into this seat 33. Plug 39 is sealed with an O-ring 49 into spout 31. The cooperative action of cap 27, plug 39 and spout 31 effectively contains the fluid in the container 11. The seat 33 formed between diameter holes 25 and 29 prevents the cap 27 from being forced inwardly at impact. The floating position of plug 39, sealed by O-ring 49 and fitted into spout 31, is maintained in a closed position by cap 27, as cap 27 is held in place by threads 35.

Once cap 27 is removed, the plug 39 may be removed, and it is provided with an extended edge 51 forming a pull lip, as shown in FIG. 4, to facilitate removal. Pour spout 31 is then extended outwardly to allow the fluid to be poured. O-ring seal 41 prevents leakage between spout 31 and the small diameter hole 29, formed by an upwardly extending collar 53 of liner 21. The spout 31 is provided with retainer lips 55 so that the spout 31 is not removed from the container 11, for sanitary reasons and to prevent it from being lost, and is not pushed loose from the port means into the container.

Figure 5:
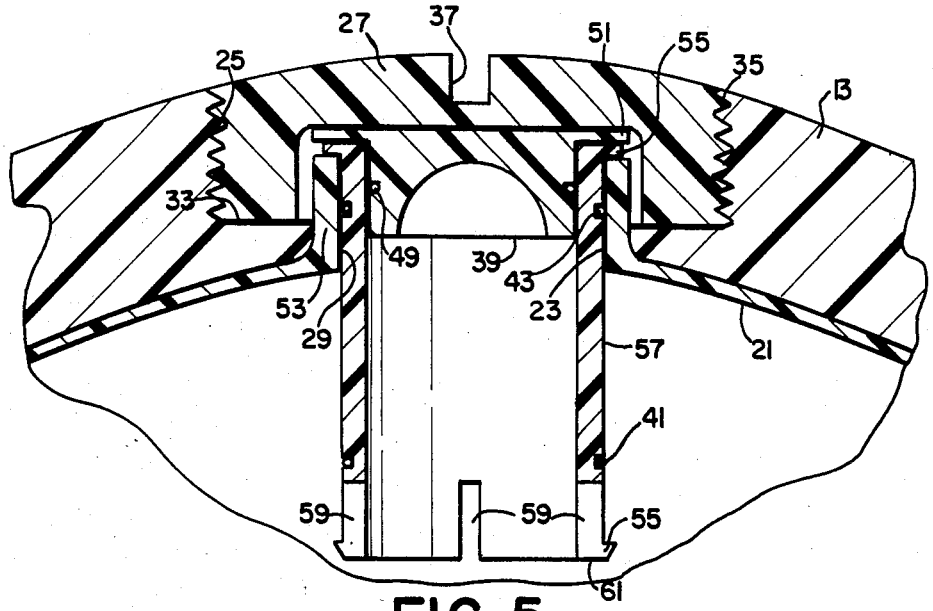
FIG. 5 is an enlarged cut away view, showing another embodiment of the invention in the closed position.
Figure 6:
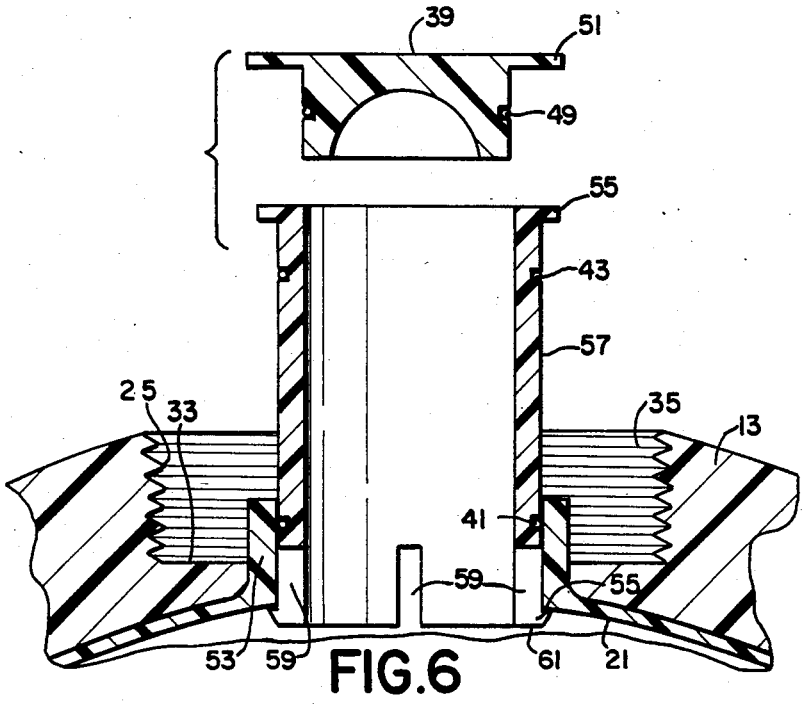
FIG. 6 is an enlarged cut away view, showing the embodiment of FIG. 5 in the open or pouring position.

An alternative embodiment of the invention is shown in closed position in FIG. 5 and in open position in FIG. 6. Cap 27 is threaded via threads 35 into shell 13. Another pour spout 57, functionally similar to spout 31, is inserted into shell 13 and liner 21 to define the small diameter hole 29 into which it fits. O-ring seal 43 operates to prevent loss of fluid between liner 21 and spout 57, and plug 39 completes the closure of the spout 57.

At the inward side of spout 57 are slots 59 which permit the ends 61 to be squeezed inwardly when the spout 57 is inserted into the container 11, and expand outwardly so retainer lips 55 prevent removal of spout 57 from the port hole.

When cap 27 is removed and spout 57 is extended for pouring, retainer lips 55 engage liner 21 and prevent undesired removal of the spout 57. Seal 43 prevents leakage between spout 57 and liner 21.

As can be seen, a container 11 holding more than 5 gallons is made which is suitable for air drop delivery to a remote location. Air drops of 5 gallon sized containers 11 have been made to remote locations at air speeds of 100 knots and higher, and from elevations of up to 1000 feet and higher with excellent success. The 5 gallons remained in the container 11, and the container 11 was not damaged by the drop. Potable liquids contained in the container 11 were delivered quickly, accurately and safely.

I claim:

1. A free drop container for liquids adapted to be dropped from aircraft, comprising a molded, impact resistant, strong and substantially rigid outer shell having a generally spherical shape and being made of a plastic material that is resilient and adapted to deform on impact and then spring back into shape, said outer shell being free-standing and self-supporting when empty, port means in said shell defining a port hole through the wall of said shell for passing liquids into and out of the container, said hole having a first diameter portion extending from the exterior partially through said shell wall and a second smaller diameter portion extending through the rest of the shell wall to the interior thereof, said first and second diameters portions defining a seat in said shell wall;

said container having a substantially smooth outer surface with no protuberances that might break on impact or might break the container on impact when the container is dropped to the ground from an aircraft;

a cap removably fitted to close said first diameter portion of said hole and forming a substantially smooth shape with the outer surface of the rest of the container so as to provide a substantially smooth outer surface with no protuberances;

an integral retractable pour spout sized to slidably fit said second diameter portion and positioned to extend out from said shell when said cap is removed and it is desired to pour the liquid from the container, and is retracted and positioned inside the container when being stored or transported so as to not protrude from the container;

plug means removably fitted in said pour spout to seal the interior of said inner shell; and a liner covering the interior of said shell made of elastic material that is adapted to expand and contract and is approved for containing water for contact with potable liquids inside said shell.

2. The container of claim 1, wherein said cap and said first diameter portion are cooperatively threaded to permit removable fitting of said cap in said hole, and the cap is sized to be supported by said seat.

3. The container of claim 1, wherein said liner is made of resilient impact resistant polyethylene material so that it does not crack or break when the outer shell is subjected to impact.

4. The container of claim 1, wherein said pour spout includes stop means for preventing said spout from being removed easily from said hole.

5. The container of claim 1, wherein said shell is comprised of molded polyether based urethane.

6. The container of claim 1, wherein said shell has slightly thicker walls at said port means and at the portion of said shell diametrically opposed to said port means.

7. The container of claim 6, wherein said slightly thicker wall opposed to said port includes a flat exterior portion forming a base so that the container sits upright with the base on the ground.

8. The container of claim 6, which further includes handle port means defining a plurality of holes in the thick portion of said walls near said port means, said holes communicating solely with the exterior of said wall and being positioned to maintain a portion of said wall between said holes and said interior of said shell.

9. The container of claim 8, which further includes handle means attached to said handle port means.

10. The container of claim 1, which further includes seal means for preventing flow of liquid between said pour spout and said second diameter portion.

11. The container of claim 1, which includes slot means in said cap means for rotatingly removing said cap.

12. The container of claim 1, which includes seal means on said plug means to prevent flow of liquid between said plug means and said pour spout.

13. The container of claim 1, wherein said plug means includes a portion of said plug extending outwardly beyond said pour spout to permit said plug means to be removed from said pour spout.

14. The container of claim 1, wherein said cap has a contoured exterior shaped to conform to the surface of said shell.

15. The container of claim 1;

said molded impact resistant shell having a generally spherical shape and having slightly thicker walls at two diametrically opposed areas on said shell, one of said thicker walls including a flat exterior portion forming a base;

said cap being sized to be supported by said seat and having a slot means in said cap for rotational removal of said cap, said cap and said first diameter portion being cooperatively threaded to permit removable fitting of said cup in said hole;

said pour spout including stop means for removal from said hole and seal means for preventing flow of liquid between said pour spout and said second diameter portion;

said plug means including a portion of said plug extending outwardly beyond said pour spout to form a pull lip to permit said plug means to be removed from said pour spout.

16. A method of delivering potable liquid from an aircraft using a free drop container to a predetermined ground location, comprising the steps of:

forming a molded, impact resistant, strong and substantially rigid outer shell having a generally spherical shape from a plastic material that is resilient and adapted to deform on impact and then spring back into shape;

providing a port means in said shell defining a hole through the wall of said shell for passing liquids into and out of the container, said hole having a first diameter extending from the exterior partially through said shell wall and a second smaller diameter extending through the rest of the shell wall to the interior thereof, said first diameter and second diameter defining a seat on said shell wall;

said container having a substantially smooth outer surface with no protuberances that might break on impact or might break the container or impact when the container is dropped to the ground from an aircraft;

providing a cap removably fitted to close said first diameter of said hole and forming a substantially smooth shape with the outer surface of the rest of the container so as to provide a substantially smooth outer surface with no protuberances;

providing an integral retractable pour spout sized to slidably fit said second diameter and positioned to extend out from said shell when said cap is removed and to remain inside said second diameter and shell interior when said cap is in place;

providing plug means removably fitted in said pour spout to seal the interior of said shell;

providing a liner covering the interior of said shell for contact with potable liquids inside said shell;

said plug means including a plug that is adapted to close a port in said liner, filling said container shell with potable liquid and closing said hole by fitting on said cap and closing the port in the liner by inserting the plug therein;

loading said filled shell on an aircraft, and dropping said filled shell from said aircraft toward said predetermined ground location while said aircraft is traveling at a speed up to 100 knots at an altitude of up to 1000 feet.

17. The method of claim 16, wherein said cap and said first diameter are cooperatively threaded to permit removable fitting of said cap in said hole, and said cap is size to be supported by said seat.

18. The method of claim 16, wherein said liner is made of resilient impact resistant polyethylene material so that it does not crack or break on impact.

19. The method of claim 16, wherein said pour spout includes stop means for preventing said spout from easily being removed from said hole.

20. The method of claim 16, wherein said shell is comprised of molded polyether based urethane.

21. The method of claim 16, wherein said shell has slightly thicker walls at said port means and at the portion of said shell diametrically opposed to said port means.

22. The method of claim 21, wherein said slightly thicker wall opposed to said port includes a flat exterior portion forming a base.

23. The method of claim 21, wherein said container further includes handle port means defining a plurality of holes in the thick portion of said walls near said port means, said holes communicating solely with the exterior of said wall and being positioned to maintain a portion of said wall between said holes and said interior of said shell.

24. The method of claim 23, wherein said container further includes handle means attached to said handle port means.

25. The method of claim 16, wherein said container further includes said seal means for preventing flow of liquid between said pour spout and said second diameter.

26. The method of claim 16, wherein said container further includes slot means in said cap means for rotatingly removing said cap.

27. The method of claim 16, wherein said container further includes seal means on said plug means to prevent flow of liquid between said plug means and said pour spout.

28. The method of claim 16, wherein said plug means includes a portion of said plug extending beyond said pour spout to permit said plug means to be removed from said spout.

29. A free drop container for liquids adapted to be dropped from an aircraft, comprising a molded, impact resistant, strong and substantially rigid outer shell having a generally spherical shape and being made of a plastic material that is resilient and adapted to deform on impact and then spring back into shape, said outer shell being free-standing and self-supporting when empty, port means in said shell defining a hole through the wall of said shell for passing liquids into and out of the container, said hole having a first diameter portion extending from the exterior partially through said shell wall and a second smaller diameter portion extending through the rest of the shell wall to the interior thereof, said first and second diameters portions defining a seat in said shell wall;

said container having a substantially smooth outer surface with no protuberances that might break on impact or might break the container on impact when the container is dropped to the ground from an aircraft;

a cap removably fitted to close said first diameter portion of said hole and forming a substantially smooth shape with the outer surface of the rest of the container so as to provide a substantially smooth outer surface with no protuberances;

an integral retractable pour spout sized to slidably fit said second diameter portion and positioned to extend out from said shell when said cap is removed and it is desired to pour the liquid from the container, and is retracted and positioned inside the container when being stored or transported so as to not protrude from the container;

plug means removably fitted in said pour spout to seal the interior of said shell;

a liner covering the interior of said shell made of elastic material that is adapted to expand and contract and is approved for containing water for contact with potable liquids inside said shell;

said plug means including a plug that is adapted to close a port in said liner;

said cap and said first diameter portion are cooperatively threaded to permit removable fitting of said cap in said hole, and the cap is sized to be supported by said seat;

said liner is made of resilient impact resistant polyethylene material so that it does not crack or break when the outer shell is subjected to impact;

said pour spout includes stop means for preventing said spout from being removed easily from said hole;

said shell is comprised of molded polyether base urethane;

said shell has slightly thicker walls at said port means and at the portion of said shell diametrically opposed to said port means;

said slightly thicker wall opposed to said port includes a flat exterior portion forming a base so that the container sits upright with the base on the ground;

handle port means defining a plurality of holes in the thick portion of said walls near said port means, said holes communicating solely with the exterior of said wall and being positioned to maintain a portion of said wall between said holes and said interior of said shell;

handle means attached to said handle port means;

seal means for preventing flow of liquid between said pour spout and said second diameter portion;

slot means in said cap means for rotatingly removing said cap;

seal means on said plug means to prevent flow of liquid between said plug means and said pour spout;

said plug means includes a portion of said plug extending outwardly beyond said pour spout to permit said plug means to be removed from said pour spout; and said cap having a contoured exterior shaped to conform to the substantially smooth outer surface of said shell.

* * * * *